US006260711B1

(12) United States Patent
Woodgate

(10) Patent No.: US 6,260,711 B1
(45) Date of Patent: Jul. 17, 2001

(54) SHIELDING DEVICE FOR SCREENING APPARATUS

(75) Inventor: Raymond Maxwell Woodgate, Melton Souch (AU)

(73) Assignee: Lettela Pty Limited, Victoria (AU)

( * ) Notice: Subject to any disclaimer, the term of this patent is extended or adjusted under 35 U.S.C. 154(b) by 0 days.

(21) Appl. No.: 08/823,956

(22) Filed: Mar. 25, 1997

(30) Foreign Application Priority Data

Mar. 25, 1996 (AU) ..... PN8876
Dec. 16, 1996 (AU) ..... 75370/96

(51) Int. Cl.[7] ..... B07B 1/49
(52) U.S. Cl. ..... 209/405; 209/399; 209/409; 52/710
(58) Field of Search ..... 209/397, 399, 209/405, 408, 409, 931; 52/704, 710

(56) References Cited

U.S. PATENT DOCUMENTS 4,040,228 * 8/1977 Skubic ..... 52/710
4,553,356 * 11/1985 Pepper ..... 52/11
5,143,223 * 9/1992 Herren ..... 209/405
5,165,453 * 11/1992 Walker, Jr. ..... 138/104
5,361,911 * 11/1994 Waites, Sr. et al. ..... 209/403 X
5,462,175 * 10/1995 Bokor ..... 209/405 X

FOREIGN PATENT DOCUMENTS

83996/75 2/1977 (AU) .
654091 2/1993 (AU) .
1641469 * 4/1991 (SU) ..... 209/405

* cited by examiner

*Primary Examiner*—Tuan N. Nguyen
(74) *Attorney, Agent, or Firm*—Merchant & Gould P.C.

(57) ABSTRACT

A shielding device 23, 24, in apparatus 1 for screening ore or like material includes an elongate body portion 25 for location over the top surface 7 of a support beam 3 of a support frame for screen panels 6. The shielding device includes at least one skirt 26 projecting from a side of the body portion 25. The device is locatable between the screen panels 6, a fixing member 13 for the screen panels and the beam 3 and provides a surface 27–27*a* for collecting fines material that ingresses between the screen panels 6 and fixing member 13 and deflecting it away from the beam 3. Use of the shielding devices reduces wear on the support beams 3 due to the abrasive fines material. The shielding devices are consumable items and can be replaced.

22 Claims, 2 Drawing Sheets

SHIELDING DEVICE FOR SCREENING APPARATUS

FIELD OF THE INVENTION

This invention relates generally to apparatus for screening, separating or grading materials and in particular to a shielding device for protecting parts of the apparatus from material that may ingress into the apparatus. The shielding device is applicable for use in apparatus for screening, separating and grading ores or other like materials, and it will be convenient to hereinafter describe the invention in relation to this exemplary application. It is to be understood, however, that the invention is not limited to such apparatus.

BACKGROUND OF THE INVENTION

A variety of apparatus systems have been developed for screening, separating and grading ores. A preferred apparatus includes a plurality of screen panels which are fixed to a support frame whereby individual panels can be easily and rapidly removed and replaced when worm. Screening apparatus of this type, with which the invention is concerned, is of any suitable construction well known to those skilled in the art. In that regard, the apparatus will include a support frame typically constructed of frame members for providing underlying support for a screen surface. An array of screen panels are fixed to the frame to form a continuous screen surface. The screen surface may be flat or cambered such as in deck screen apparatus, or may be curved such as in a trommel or drum screen apparatus. Each screen panel is typically square or rectangular in plan shape, with an upper or inner screening surface for receiving ore to be screened and a lower or outer bearing surface that may bear on the underlying support frame members. Apertures extend through the screen panels between the screening and bearing surfaces to provide for ore screening and separation.

One fixing arrangement used in this apparatus is disclosed in Australian patent 654091. This patent discloses the use of an elongate U-shaped fixing member for securing to the support frame so as to extend longitudinally between side edge regions of adjacent screen panels. The fixing member has a pair of connection portions, with connection elements being provided along the outer side surfaces of the connection portions and the side edge faces of the screen panels. The connection elements of each connection portion and an associated screen panel interengage to hold the screen panels in position on the support frame. The connection portions are inwardly deflectable away from the side edge faces in order to disengage the connection elements and disconnect the screen panels from the fixing member. A retaining member is provided for extending along the fixing member in engagement with the connection portions to resist their inadvertent deflection, and thus maintain engagement between the connection elements.

Another system for fixing the screen panels to the support frame incorporates an elongate fixing member to which a pair of panels are able to be secured. The fixing member is securable to an upper surface of the support frame and is adapted to extend between and below facing side edges of adjacent screen panels. In this arrangement, each of these side edges of the panels include downwardly projecting connecting portions which are cooperable with an adjacent portion of the fixing member. The system further includes a retaining member which is engageable with the panels so as to clamp each connection portion between the fixing member and the retaining member such that each screen panel is secured to the support frame.

In use, the whole apparatus including the support frame and panels is vibrated so that the material is able to move across the screen surface. While these fixing systems are effective in retaining the panels to the support frame, fine grade material, commonly referred to as "fines", is prone to ingress in between the component parts of the apparatus. These fines are highly abrasive and increase wear on the components. The panels and the fixing members are typically formed from a plastics material, such as polyurethane, and are consumables. Consequently the wear of the panels and fixing members is expected and is not a major problem. However the fines are also able to lodge in between the fixing member and frame members of the support frame and as the support frame is not a consumable, this can cause excessive wear to the screening apparatus.

Typically the support frame is formed from steel and the ingress of fines into contact with frame members can cause pitting of the steel which can accelerate corrosion of the frame. In an effort to prevent this, resin coatings have been applied to the vulnerable frame surfaces. However this approach has only provided a short term solution as over time, the fines wear through the coating.

SUMMARY OF THE INVENTION

An aim of the invention is to provide another solution to this problem.

In its broadest terms, the present invention provides a shielding device for a frame member in screening apparatus of the type having at least one screen panel securable to a support frame wherein the device includes an elongate body portion locatable between a screen panel and a frame member of the support frame and at least one projecting portion, wherein the body portion and the projecting portion provide at least one surface which, in use of the shielding device, extends below an edge region of the screen panel for collecting material that passes over or through that edge region and deflecting it away from the frame member.

Preferably the or each projecting portion is a skirt that projects from the body portion.

An advantage of the present invention is that in operation of the screening apparatus any fines which ingress through the fixing arrangement of the apparatus or the screening apertures of a screen panel overlying the support frame are deflected away from the support frame. A further advantage is that the shielding device is able to minimise the abrasive effects of the fines by deflecting the material out of the screening apparatus. Further, the shielding device can be manufactured and supplied as a consumable and if required can be easily replaced when the other consumables of the screening apparatus, such as screen panels and fixing members, are replaced.

The invention is described herein with reference to the screening apparatus in a normal use orientation wherein it has an horizontally extending screen deck frame, and terms such as "above", "upward", "downward", "upper" and "lower" should be construed in the light of this orientation. However, it is to be understood that other orientations may be equally possible and that consequential changes in terms such as those above may be required in the light of those orientations.

Preferably the body portion includes means for retaining the shielding device over a frame member in the screening apparatus.

In one form, the screening apparatus includes a fixing member securable to an upper surface of a frame member of the support frame and wherein an edge region of the screen panel is adapted to be secured to the fixing member through an arrangement of inter-fitting projections and recesses. When used in this arrangement, the shielding device is adapted to extend below the fixing member and over the frame member to deflect material passing between the panel and the fixing member away from the upper surface of the frame member. Alternatively the shielding device may be an integrally formed part of the fixing member.

A shielding device according to the present invention is particularly suitable for use with a fixing system in screening apparatus that includes a fixing member that is fixedly locatable adjacent an edge face of a screen panel. However it is to be appreciated that the shielding device may be employed in other fixing arrangements, such as when a screen panel is adapted to overlay a fixing member.

In one form, the shielding device includes a retaining lug with which another part of the screening apparatus is engageable for retaining the device over a frame member. Preferably this lug upstands from an upper surface of the body portion. In this arrangement the retaining lug is adapted to abut a fixing member and/or a screen panel to inhibit relative movement therebetween. In another form, the shielding device includes an aperture for passage of a fastener for securing the device to a frame member. In one form, the fastener may also secure a fixing member to the support frame member.

In one form, the device includes a pair of skirts, each of which projects from a respective longitudinal side of the body portion, the skirts extending continuously along the body portion sides. This arrangement is particularly advantageous for use with two adjacent screen panels as the shielding device can deflect any fines away from the repectve panels in opposite directions.

A shielding device according to the invention is preferably formed in continuous lengths and may extend along either the entire length of a frame member or part thereof with the projecting portion or skirt extending laterally beyond a side edge of the frame member.

BRIEF DESCRIPTION OF THE DRAWINGS

For a better understanding of the invention, embodiments thereof will now be described, by way of example only, with reference to the accompanying drawings. The specific form and arrangement of the various features shown in the drawings is not to be understood as limiting on the invention, the scope of which is to be determined according to the generality of the preceding description. It is also to be understood that the specific form of a future of the invention as shown in one embodiment may be applied to or interchanged for the specific form of a corresponding feature as shown in another embodiment.

In the drawings.

DETAILED DESCRIPTION OF THE PREFERRED EMBODIMENT

Figure 1:
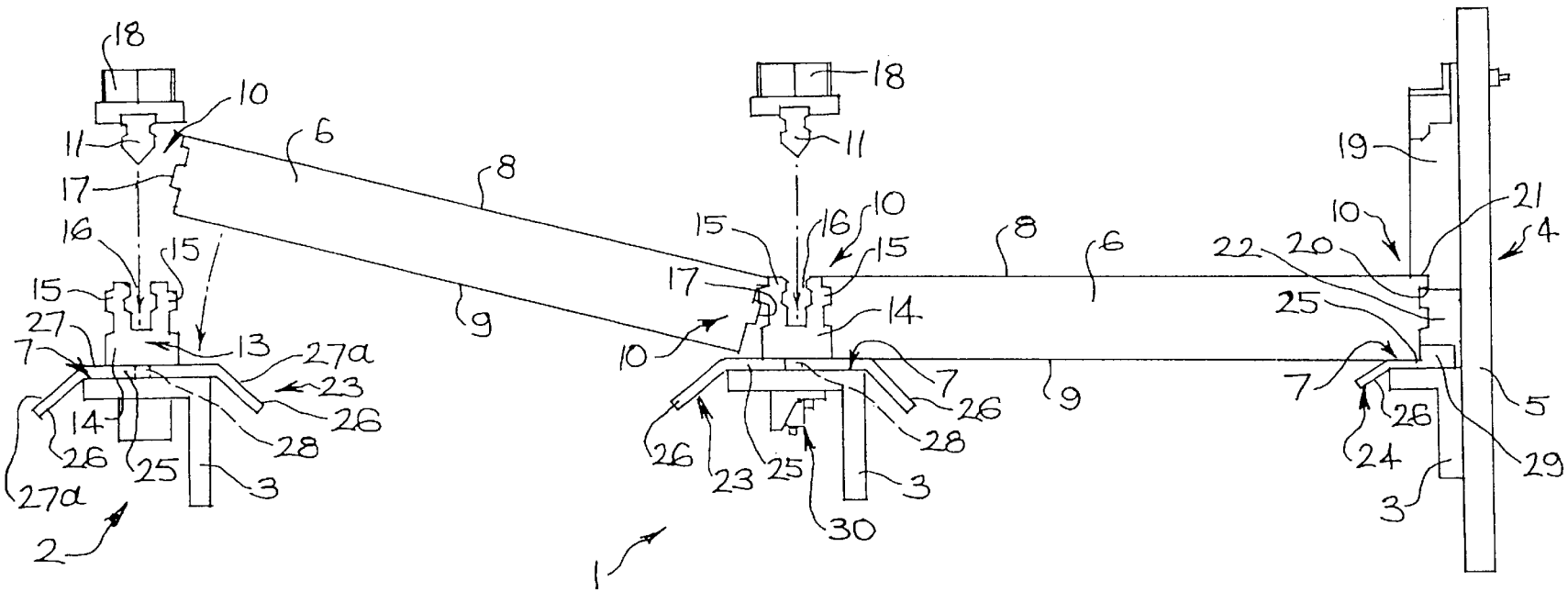
FIG. 1 is a partially exploded end view of screening apparatus incorporating shielding devices according to two embodiments of the present invention.

The screening apparatus shown in FIG. 1 is based on the screening apparatus which is described in detail in the applicants previous Australian patent no. 654091. However, it is to be understood that the shielding devices may be incorporated in other screening apparatus such as drum or trommel screens or the like and may be used with fixing arrangements other than those described hereinafter.

In the illustrated arrangement, the deck screening apparatus 1 includes a support frame 2 which includes parallel spaced frame members in the form of support beams 3 extending along the screen deck. The screen deck support frame 2 also includes side structures 4 (only one of which is shown at the right hand side), each including a side beam 5 fixed to a support beam 3.

A plurality of screen panels 6 forming an array are fixed to, and supported by, an upper surface 7 of the frame support beams 3 with each screen panel 6 being supported by a pair of the support beams 3. Each screen panel 6 is typically flat, and has a square or rectangular plan shape, with an upper screening surface 8 for receiving ore or other material to be screened and a lower bearing surface 9. Each screen panel 6 has a pair of opposed side edge regions 10. Apertures (not shown) extend through each screen panel 6 between the screening and bearing surfaces 8, 9 to provide the ore screening and separation.

The screen panels 6 are preferably cast or moulded from a plastics material, such as polyurethane, and may be internally reinforced with one or more metal elements, such as steel bars (not shown). It is to be understood that alternative materials and methods of production for the screen panels 6 are possible.

The screening apparatus 1 includes a fixing system for releasably fixing the screen panels 6 to the frame support beams 3. This fixing system includes fixing members 13 which are in the form of elongate rails, each of which extends along a respective support beam 3 so that the fixing rails 13 are in parallel spaced apart relation and positioned between adjacent screen panels 6. Each fixing rail 13 includes an elongate base portion 14 and a pair of connection portions 15 extending along and upstanding from the base portion 14. The connection portions 15 are laterally spaced and thus define a clearance groove 16 therebetween. Thus, each fixing rail 13 has a generally U-shaped cross sectional profile defined by the base portion 14 and upstanding connection portions 15.

Connection elements in the form of ribs 17 are formed on the side edge faces of screen panels 6. These ribs 17 are adapted to interfit with grooves formed in the connection portions 15 of the fixing members 13 to hold the screen panels in position on the support frame. In this way the fixing members 13 are located between adjacent screen panels 6.

The connection portions 15 of a fixing rail 13 are deflectable away from the facing side edge faces of adjacent screen panels in order to disengage the connection elements or ribs 17 and disconnect a screen panel 6 from the fixing rails 13 to allow removal of the panel. Retaining elements 18 are provided, each of which has a plug portion 11 locatable within the clearance groove 16 of a fixing rail 13 to resist inadvertent deflection of the connection portions 15 thus maintaining the screen panels 6 in engagement with the fixing rails 13.

The apparatus 1 also includes a clamp member in the form of a bar 19 extending along the side beam 5. Bar 19 is held in position by clamp members spaced along side beam 5. The clamp members 19 (there is one along each side) are arranged such that the outermost side edge regions 10 of the screen panels 6 (adjacent side beams 5) are clamped to the frame support beams 3.

In this embodiment, the lower edge 20 of a clamp bar 19 is shaped to fit or mate with a side edge region 10 of adjacent screen panels 6 and thereby facilitate screen panel fixing. To that end the lower edge 20 of the clamp bar is laterally stepped so as to provide a relief section 21 into which an upper corner of the side edge region 10 of the screen panels 6 is received. Thus the clamp members 19 are clamped down onto the upper surface 8 of the screen panels 6 and also fit into a gap 22 between the screen panels 6 and adjacent side beams 5. That fit can be an interference fit so as to apply a transverse force to the panels 6 which acts to press the screen panels into engagement with a fixing rail 13 along the opposite sides of the panels.

According to the invention the screening apparatus 1 further includes elongate shielding devices 23, 24 which are locatable between the screen panels 6 and the support beams 3. These shielding devices are for preventing fines which may ingress between the component parts of the screen panel fixing arrangement or through the screening apertures of a panel 8 that are proximate the side edge regions 10 thereof from coming into contact with the support beams 3.

Two forms of a shielding device are disclosed; device 23 (shown in greater detail in FIG. 2) is for location under a fixing rail 13 and device 24 (shown in greater detail in FIG. 3) is for location against a side beam 5.

Figure 2:
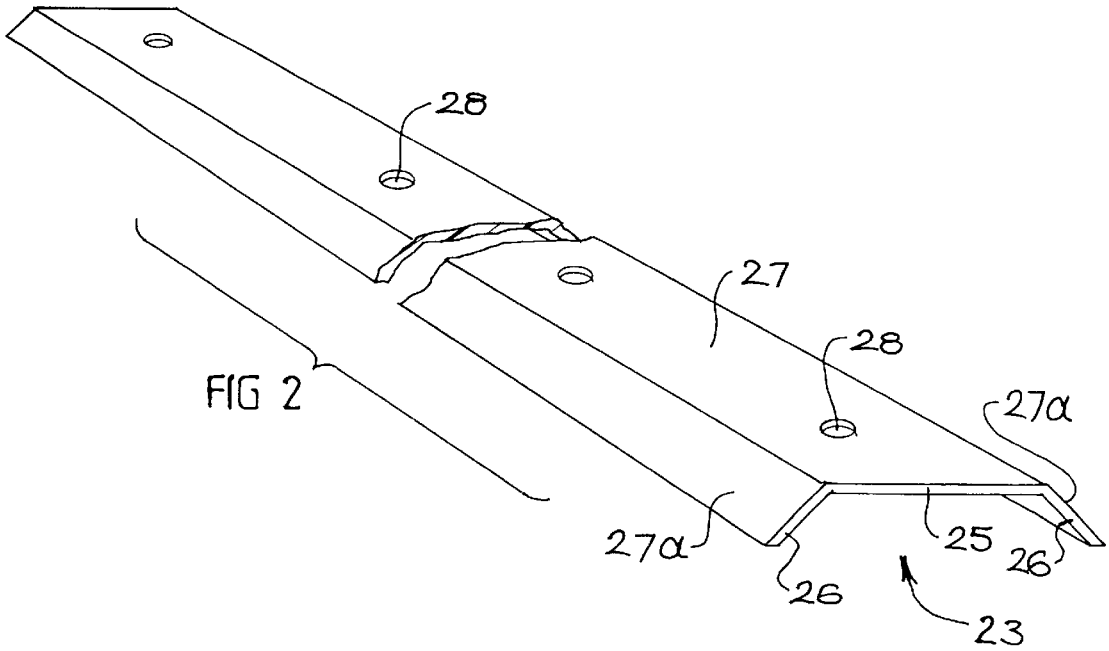
FIG. 2 is a perspective view of one of the shielding devices of FIG. 1.
Figure 3:
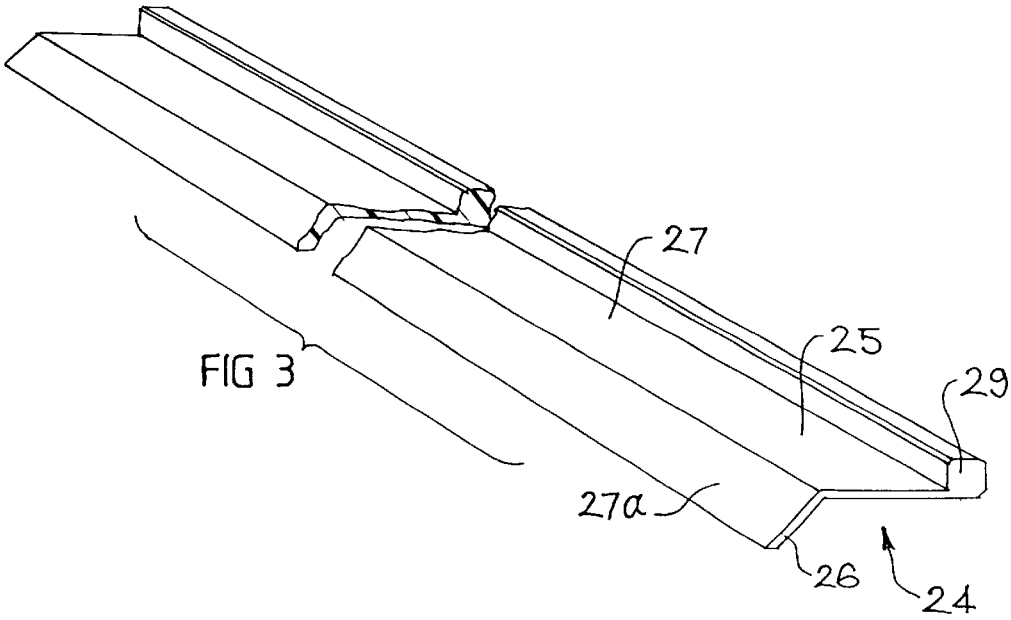
FIG. 3 is a perspective view of the other shielding device of FIG. 1.

Referring initially to FIG. 2, the shielding device 23 includes an elongate body portion 25 which is substantially planar and which to locatable between a fixing member 13 and a support beam 3. The body portion 25 is of a width to extend across the entire width of the upper surface 7 of the support beam 3, as shown in FIG. 1. The shielding device 23 further includes a pair of projecting portions in the form of skirts 28 extend continuously along, and which project laterally from, opposite edges of the body portion 25 and are downwardly angled. Thus the shielding device 23 provides an upper surface 27 which collects any fines or slurry of the ore which works its way between a fixing member 13 and the adjacent panels 6 as the ore being screened passes over the upper surface of the screen deck. This surface 27 joins with the upper surfaces 27*a* of skirts 26 which deflect the collected fines away from the support beam 3. The surfaces 27 and 27*a* may be smoothly joined such that there is, effectively, a single surface for collecting and deflecting the fines, for example, the skirts 26 could be curved. Although not shown, the invention also includes within its scope projecting portions that are not angled relative to the body portion such that a substantially flat upper surface for collecting and deflecting the fines is provided.

Each fixing rail 13 is mounted to a support beam 3 by any suitable arrangement. In the illustrated embodiment, the rails 13 are bolted to the underlying support beams 3 by means of spaced bolts 30 carried by the base portion 14 and depending therefrom through apertures (not shown) in the beams 3. With this arrangement, the body portion 25 of a shielding device 23 also includes apertures 28 for passage of the bolts 30. Alternatively the shielding device 23 may be an integrally formed part of fixing rail 13.

The shielding device 24, (shown in FIG. 3) similarly to the device 23, is for deflecting material passing over the outermost side edge region 10 of a screen panel 6 that may ingress between the panel, clamp bar 19 and side beam 5 form depositing on the underlying frame member 3. As the shielding device 24 is for mounting adjacent a side beam 5 only a single skirt 28 projecting from the body portion 25 is required. Shielding device 24 includes a retaining lug 29 which upstands from the body portion 25 and is sized for location within the gap 22 formed between the side beam 5 and an adjacent screen panel 6. This retaining lug 29 inhibits relative movement between the screen panel 6 and the frame beam 3. The projecting portion of shielding device 24, as in the device 23, need not be a skirt, that is, a downwardly angled or curved portion, but could extend substantially straight out from the body portion.

The shielding devices 23 and 24 may be cast or moulded in one piece from plastics material, such as polyurethane. Typically the shielding devices are cast into lengths which are similar to the lengths of the fixing rails 13. However it is to be appreciated that the shielding devices may be of shorter length if desired.

In operation of the screening apparatus 1 the frame members or support beams 3 carrying the screen panels 6 are vibrated to cause the ore to move across the upper surfaces 8 of the respective screen panels. During this operation any material, such as fines or slurry which works its way over the edge regions 10 of the screen panels 6 or through the screen apertures which overlie the support beams 3 will be deposited on one of the shielding devices 23 or 24. On continued operation of the screening apparatus 1, this material will tend to work towards the edges of the body portion 25 of the shielding devices, onto the projecting portion(s) or skirt(s) and then over its or their edges thus deflecting it away from the frame members. The upper surfaces 7 of the frame support beams 3 are best protected by projecting portions in the form of skirts 26 as these depend below those upper surfaces.

Due to the abrasive nature of the fines, over time the shielding devices, in particular the body portions 25, will wear down and require replacement. However, it is expected that the wearing of the shielding devices will not be any greater than the other consumable parts of the screening apparatus such as the fixing rails 13. As a consequence these component parts can be replaced together during a regular overhaul of the system.

The invention described herein is susceptible to variations, modifications and/or additions other than those specifically described and it is to be understood that the invention includes all such variations, modifications and/or additions which fall within the spirit and scope of the following claims.

What is claimed is:

1. In a shielding device in a screening apparatus having a support frame with a support beam, and at least one screen panel secured to the support frame, the improvement comprising:

an elongate body portion positioned on an upper surface of the support beam and beneath an edge region of the screen panel, the body portion extending along the upper surface of the support beam and across the upper surface of the support beam to at least one outer longitudinal edge of the support beam so as to overlie the support beam; further including at least one skirt portion extending along the body portion and projecting downwardly from the body portion to a free edge of the skirt portion, the free edge being spaced downwardly from the outer longitudinal edge of the support beam; the body portion and the skirt portion providing at least one upper surface which extends beneath the edge region of the screen panel for collecting material that passes over or through the edge region and deflects its down over the free edge of the skirt portion away from the support beam.

2. Screening apparatus comprising: a support frame having support beams, at least one screen panel having opposite edge regions supported on and secured to respective support beams, and a plurality of shielding devices located between each screen panel and support beam, each shielding device comprising: an elongated body portion positioned on an upper surface of the support beam so as to be located above the support beam and beneath an edge region of the screen panel which extends along the support beam, the body portion extending along the upper surface of the support beam and across the upper surface of the support beam to at least one outer longitudinal edge of the support beam so as to overlie the support beam; and, at least one skirt portion extending along the body portion and projecting downwardly from the body portion to a free edge of the skirt portion, the free edge of the skirt portion being spaced downwardly from the outer longitudinal edge of the support beam, the body portion and the skirt portion providing at least one upper surface which extends along beneath the edge region of the screen panel for collecting material that passes over or through that edge region and deflecting the material down over the free edge of the skirt portion away from the support beam.

3. Screening apparatus according to claim 2, wherein the apparatus includes at least two adjacent screen panels between which at least one fixing member extends for securing the panels in position, and at least one of the shielding devices has two skirt portions each projecting laterally outwardly and downwardly from a respective longitudinal side of the body portion, said at least one shielding device providing a surface which extends below adjacent edge regions of the two panels, and said at least one shielding device being retained over the support beam by at least one fastener that secures the fixing member to the support beam.

4. Screening apparatus according to claim 2, wherein the apparatus includes at least two adjacent screen panels between which a fixing member extends to secure the panels in position, and the fixing member and at least one of the shielding devices are formed integral with one another.

5. Screening apparatus according to claim 2, wherein at least one screen panel is adjacent a side beam of the apparatus and the side beam includes a clamp member for clamping the panel in position, and the body portion of the shielding device includes a retaining lug, the shielding device being retained over the support beam by the clamping of the screen panel with the retaining lug of the device engaging an edge face of the panel.

6. A screening apparatus, comprising:

a support frame having a support beam with an upper surface, and an outer longitudinal edge;

at least one screen panel secured to the support frame, the screen panel including an edge region that extends along the support beam;

a shielding device for the support frame, the shielding device comprising an elongate body portion positioned on the upper surface of the support beam and beneath the edge region of the screen panel, the body portion extending along the upper surface of the support beam and across the upper surface of the support beam to the outer longitudinal edge of the support beam so as to overlie the support beam; the shielding device further including at least one skirt portion extending along the body portion and projecting downwardly from the body portion to a free edge of the skirt portion, the free edge being spaced downwardly from the outer longitudinal edge of the support beam;

wherein the body portion and the skirt portion provide at least one upper surface which extends beneath the edge region of the screen panel for collecting material that passes over or through the edge region and deflects its down over the free edge of the skirt portion away from the support beam.

7. The screening apparatus according to claim 6, wherein the skirt portion projects laterally outwardly from the body portion.

8. The screening apparatus according to claim 6, wherein the skirt portion projects from a longitudinal side of the body portion.

9. The screening apparatus according to claim 8, wherein the skirt portion extends continuously along the longitudinal side of the body portion.

10. The screening apparatus according to claim 6, wherein the body portion includes means for retaining the shielding device over the support beam in the screening apparatus.

11. The screening apparatus according to claim 10, wherein the retaining means includes at least aperture for passage of a fastener.

12. The screening apparatus according to claim 10, wherein the retaining means includes a lug with which another part of the screening apparatus is engageable.

13. The screening apparatus according to claim 10, wherein the retaining means includes a fixing member that secures the screen panel to the support frame, the fixing member and the body portion being integrally formed.

14. The screening apparatus according to claim 6, wherein the shielding device is formed in one piece from a plastic material.

15. The screening apparatus according to claim 6, wherein the elongate body portion has an elongate upper surface that extends along and below, and is positioned in face-to-face relation with, a lower surface of the screen panel.

16. The screening apparatus according to claim 6, wherein the body portion has an elongate lower surface that extends along and above, and is positioned in face-to-face relation with, the upper surface of the support beam.

17. The screening apparatus according to claim 6, wherein the body portion is generally planar, and has opposite elongate upper and lower surfaces, the lower surface extends along and above, and is bears in face-to-face relation on, the upper surface of the support beam, and the screen panel includes a lower surface that extends along and above, and bears in face-to-face relation on, the upper surface of the body portion.

18. In a shielding device in a screening apparatus having a support frame with a support beam and having at least one screen panel secured to the support frame, the improvement comprising:

an elongate plate portion that is configured to permit positioning on an upper surface of the support beam, the plate portion having a pair of longitudinal sides and a lower surface extending along the plate portion and from one longitudinal side to the other longitudinal side, the lower surface having a size sufficient to permit the lower surface to bear in face-to-face relation with the upper surface of the support beam along the upper surface of the support beam and across the upper surface of the support beam to at least one outer longitudinal edge of the support beam, and the plate portion having means for retaining the shielding device in position overlying the support beam; and at least one skirt portion extending along at least one of the longitudinal sides of the plate portion and projecting downwardly from the plate portion to a free edge that is configured to be spaced downwardly from the outer longitudinal edge of the support beam, the plate portion and the skirt portion defining at least one upper surface that is configured to extend along and beneath an edge region of the screen panel for collecting material that passes over or through the edge region and deflecting it down over the free edge of the skirt portion away from the support beam.

19. In a shielding device in a screening apparatus having a support frame with a support beam and having at least one screen panel secured to the support frame with a fixing rail fastened along the support beam, the improvement comprising:

an elongate plate portion configured for positioning on an upper surface of the support beam beneath the fixing rail and an edge region of the screen panel, the plate portion configured to extend along the upper surface of the support beam and across the upper surface of the support beam to opposite outer longitudinal edges of the support beam so as to overlie the support beam; the plate portion having a plurality of apertures arranged in spaced apart relation therealong, the apertures extending through the plate portion to permit passage of fasteners for fastening the fixing rail to the support beam; and a pair of skirt portions extending along longitudinal sides of the plate portion and projecting laterally outwardly and downwardly from the plate portion to free edges that are configured to be spaced laterally outwardly and downwardly from the outer longitudinal edges of the support beam, the plate portion and the skirt portions defining an upper surface that is configured to extend along and beneath the fixing rail and the edge region of the screen panel for collecting material that passes through the edge region or between the fixing rail and edge region, and deflecting the material down over the free edges of the skirt portions away from the support beam.

20. The shielding device according to claim 19, wherein the plate portion has a lower surface that is configured to bear in face-to-face relation with the upper surface of the support beam, and the apertures extend through the plate portion between and opening into the upper and lower surfaces.

21. In a shielding device in a screening apparatus having a support frame with a support beam and having at least one screen panel secured to the support frame with a clamp bar extending along the support beam and clamping an edge region of the screen panel to the support beam, the improvement comprising:

an elongate plate portion configured for positioning on an upper surface of the support beam between the support beam and the edge region of the screen panel, the plate portion configured to extend along the upper surface of the support beam and across the upper surface of the support beam to an outer longitudinal edge of the support beam so as to overlie the support beam;

a retaining portion extending along the plate portion and co-operable with the edge region of the screen panel to retain the shielding device in position when the clamp bar clamps the edge region to the support beam; and a skirt portion extending along a longitudinal side of the plate portion and projecting laterally outwardly and downwardly from the plate portion to a free edge that is configured to be spaced laterally outwardly and downwardly from the outer longitudinal edge of the support beam; the plate portion and the skirt portion defining an upper surface that is configured to extend along and beneath the edge region of the screen panel for collecting material that passes through the edge region or between the clamp bar and the edge region, and deflecting the material down over the free edge of the skirt portion away from the support beam.

22. The shielding device according to claim 21, wherein the retaining portion comprises an elongate retaining lug extending along the upper surface of the plate portion, and the retaining lug is integrally formed with the plate portion.

* * * * *

UNITED STATES PATENT AND TRADEMARK OFFICE

CERTIFICATE OF CORRECTION

PATENT NO. : 6,260,711 B1
DATED : July 17, 2001
INVENTOR(S) : Woodgate

It is certified that error appears in the above-identified patent and that said Letters Patent is hereby corrected as shown below:

Title page,
Item [75] Inventors, "Melton Souch (AU)" should read -- Melton South, Victoria (AU) --

Column 5,
Line 20, "panel 8" should read -- panel 6 --
Line 33, "skirts 28" should read -- skirts 26 --
Line 65, "skirt 28" should read -- skirt 26 --

Signed and Sealed this

Thirtieth Day of July, 2002

*Attest:*

*Attesting Officer*

JAMES E. ROGAN
*Director of the United States Patent and Trademark Office*